US006671087B2

(12) United States Patent
Boaz

(10) Patent No.: US 6,671,087 B2
(45) Date of Patent: Dec. 30, 2003

(54) REFLECTOR ASSEMBLY FOR UV-ENERGY EXPOSURE SYSTEM

(76) Inventor: Premakaran T. Boaz, 16842 Yorkshire, Livonia, MI (US) 48154

( * ) Notice: Subject to any disclaimer, the term of this patent is extended or adjusted under 35 U.S.C. 154(b) by 0 days.

(21) Appl. No.: 10/212,398

(22) Filed: Aug. 5, 2002

(65) Prior Publication Data

US 2003/0206339 A1 Nov. 6, 2003

Related U.S. Application Data

(60) Provisional application No. 60/371,017, filed on Apr. 9, 2002.

(51) Int. Cl.[7] ..... F21V 9/06

(52) U.S. Cl. ..... 359/361; 359/360; 359/359; 359/350

(58) Field of Search ..... 359/361, 350, 359/351, 359, 360, 838; 101/35, 39, 40, 116, 119, 120, 122; 385/115, 31

(56) References Cited

U.S. PATENT DOCUMENTS 4,684,388 A 8/1987 Boaz
4,820,015 A * 4/1989 Mogi ..... 385/115
4,857,096 A 8/1989 Boaz
5,487,927 A 1/1996 Kamen et al.
5,502,310 A 3/1996 Niestrath et al.
5,520,973 A 5/1996 Kamen et al.
5,562,951 A 10/1996 Kamen
5,571,359 A 11/1996 Kamen et al.
5,585,153 A 12/1996 Kamen et al.
5,656,336 A 8/1997 Kamen et al.
5,667,856 A 9/1997 Kamen et al.
5,708,047 A 1/1998 Kamen et al.
5,739,879 A * 4/1998 Tsai ..... 349/62
5,827,345 A 10/1998 Boaz et al.
5,985,376 A 11/1999 Kamen
6,093,455 A 7/2000 Kamen et al.
6,136,382 A 10/2000 Kamen et al.
6,280,801 B1 8/2001 Schmitt
6,283,022 B1 9/2001 Kamen et al.
6,350,071 B1 2/2002 Conwell et al.

* cited by examiner

*Primary Examiner*—Mohammad Sikder
(74) *Attorney, Agent, or Firm*—Bliss McGlynn, P.C.

(57) ABSTRACT

A reflector assembly for a UV energy exposure system includes a funnel adapted to be connected to a UV energy source to funnel UV energy from the UV energy source longitudinally and a reflector connected to the funnel to redirect the UV energy from the funnel laterally to an object.

11 Claims, 3 Drawing Sheets

REFLECTOR ASSEMBLY FOR UV-ENERGY EXPOSURE SYSTEM

CROSS-REFERENCE TO RELATED APPLICATION(S)

This application claims the benefit of U.S. Provisional Patent Application Ser. No. 60/371,017, filed on Apr. 9, 2002 and entitled "UV-Energy Routing System for a UV-Ink Printing Process."

BACKGROUND OF THE INVENTION

1. Field of the Invention

The present invention relates generally curing UV-sensitive ink in a UV-ink printing process and, more particularly, to a reflector assembly for a UV-energy exposure system for such process.

2. Description of the Related Art

Ultraviolet-based inks and ceramic paints and pastes (compositions) are generally well known to skilled artisans. The compositions are used, for example, to form glass sheets, in general, and borders around the edges of glass sheets, in particular, which are used as windshields, sidelights, and backlights in motor vehicles.

Such a composition usually includes a mixture of metal oxides, which together act as a coloring agent for the composition. The metal oxides are non-reactive with one another and any elements or compounds with which they normally come into contact while being heated to about 1300° F. The mixture of metal oxides can be controlled to get a selected color from the composition. Normally, in automotive applications, the selected color is black, and shades of gray are popular as well.

The composition also includes a glass frit that generally melts at a temperature below 1300° F. The glass frit is the material that bonds the mixture of metal oxides to a glass sheet, for instance, and ensures that the mixture remains after the glass sheet has been cooled back to room temperature.

A UV-based organic medium is normally mixed with the metal oxides and the glass frit to allow the composition to be applied in a paint-application process. For example, if such a process is a screen-printing operation, then the UV-based organic medium carries, or transports, the metal oxides and the glass frit during the operation. The metal oxides, glass frit, and UV-based organic medium are mixed to form a liquid UV-based ceramic paint or paste that can be screen painted.

In the motor-vehicle application described above, the UV-based ceramic paint or paste is then applied to the glass sheet. After such application, the glass sheet is subject to UV radiation to set-up the UV-based ceramic paint or paste. The glass sheet is then heated to a temperature that softens the glass sheet sufficiently such that the glass sheet can be formed. The heating step also drives off any volatiles, such as burning off all organic material, remaining in the UV-based ceramic paint or paste after the UV-curing step. The heating step also firmly bonds the remaining portion of the UV-based ceramic paint or paste to the glass sheet.

The glass sheet and the UV-based ceramic paint or paste thereon are then engaged with, for instance, a fiberglass-covered forming die to form the heated glass sheet to a desired shape. After shaping, the forming die is removed from engagement with the glass sheet. After the forming die has been removed from engagement with the glass sheet and the UV-based ceramic paint or paste, the glass sheet may be cooled to obtain a formed glass sheet with ceramic paint or paste thereon. Normally, the glass sheet is rapidly cooled in a glass-tempering operation to achieve a tempered-glass product having the ceramic paint or paste thereon.

Many types of compositions of the above general type are well known to skilled artisans in this area. Further, the selection of the exact metal oxides, glass frit, and UV-based organic medium to use for such compositions is well within the skill of such artisans. Further, the manner in which the different materials may be mixed and varied to achieve the results desired in a particular application is also well within the skill of such artisans.

Recently, there has been significant improvement in the color formulations of the compositions. Meanwhile, multiple prints have become very popular in various industries, including the beverage and the perfume bottles industry. As such, these industries have been using the improved color formulations to make their respective wares. In the beverage industry, these wares may include glassware, for instance.

It may be desired to print glassware with, for example, three colors. In a conventional set-up, to cure the UV-sensitive compositions (after they have been applied to the glassware and before the glassware is heated to a temperature to heat fuse the paint ceramic color to the ware or so that the glassware can be formed), the glassware is typically passed through a series of UV ovens, the number of ovens depending upon the number of print requirements. In this way, the glassware is subjected to UV radiation to set-up the compositions such that they are bonded to the glassware.

A separate screen-printing station is typically used ahead each of the UV ovens. The glassware, with the UV-sensitive compositions printed thereon, is routed through an enclosure, such as a set of doors, of each of the UV ovens to allow the glassware to pass through the UV ovens, as escapement of UV energy from the UV ovens is restricted. While the glassware is in the ovens, it is exposed to a UV source within an enclosed chamber defined by each of the UV ovens.

As can easily be seen, this UV-energy exposing system for curing UV-sensitive inks in a UV-ink printing process takes the glassware to the UV source. The system of the related art can use much space, require much handling of the glassware, and require much time between consecutive printing operations in multiple-print requirements. In addition, with the system of the related art, a new set of equipment, having high initial investment cost, will be required to make use of the new UV-based inks and ceramic paints and pastes.

This system also applies to UV sensitive compositions that do not have any ceramic or glass inclusions. Decorations consisting of just organic colors and UV sensitive binders are used in the container, perfume, and beverage industry. In these cases, the decoration process is complete once the ware is exposed to the UV light. The bond to the substrate and other durability attained are enough for most uses.

Thus, there is a need in the art for a UV-energy routing system for a UV-ink printing process that brings the UV energy to the glassware, does not use much space, does not require much handling of the glassware, and does not require much time between consecutive printing operations in multiple-print requirements, and makes use of the new UV-based inks and ceramic paints and pastes.

Additionally, there is a need in the art to provide a reflector for a UV-energy routing system. There is also a need in the art to provide a reflector that directs energy by reflection on two stations simultaneously. Therefore, there is a need in the art to provide a reflector assembly that meets these desires.

SUMMARY OF THE INVENTION

Accordingly, the present invention is a reflector assembly for a UV-energy exposure system for a UV-ink printing process. The reflector assembly includes a funnel adapted to be connected to a UV energy source to funnel UV energy from the UV energy source longitudinally and a reflector connected to the funnel to redirect the UV energy from the funnel laterally to an object location.

One advantage of the present invention is that a reflector assembly is provided for a UV-energy exposure system for a UV-ink printing process that brings the UV energy to the substrate. Another advantage of the present invention is that a reflector assembly is provided for the UV-energy exposure system that does not use much space. Yet another advantage of the present invention is that the reflector assembly is placed in between two printing stations and directs the energy by reflection onto the two stations simultaneously. Still another advantage of the present invention is that the reflector assembly can be used to direct the energy to only one station if required.

Other objects, features, and advantages of the present invention will be readily appreciated, as the same becomes better understood, after reading the subsequent description taken in conjunction with the accompanying drawings.

DESCRIPTION OF THE PREFERRED EMBODIMENT

Figure 1:
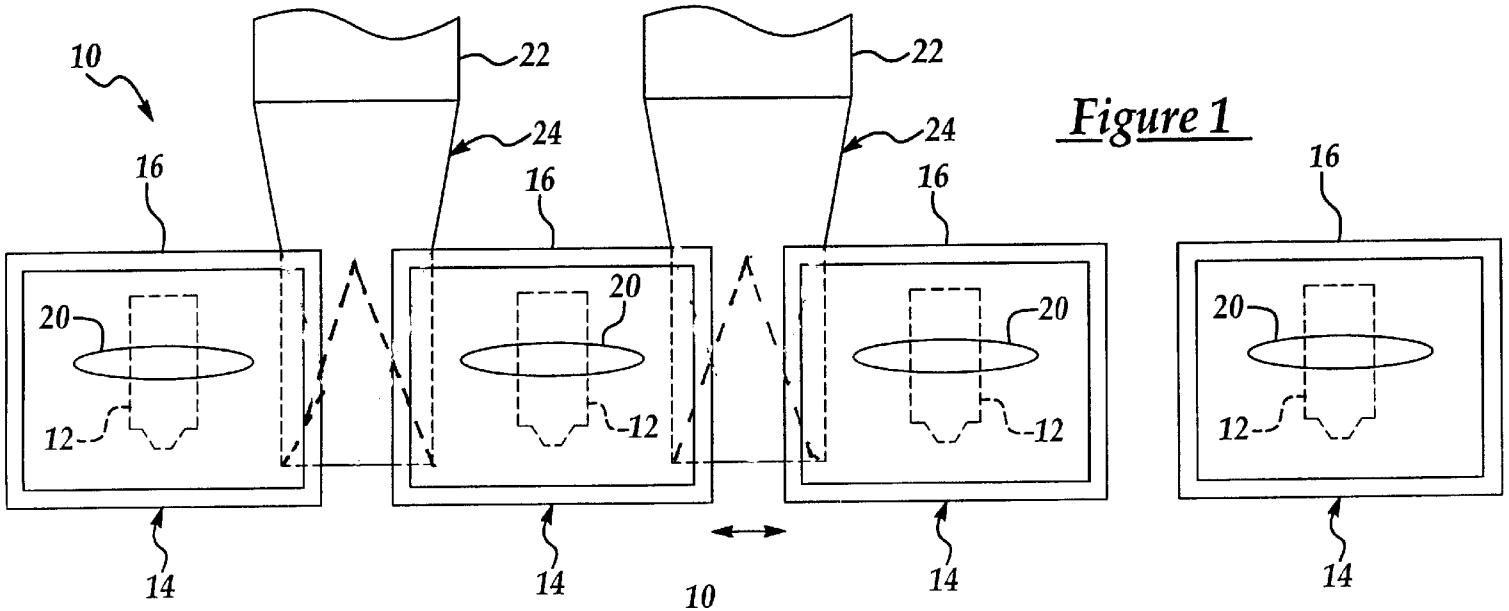
FIG. 1 is a diagrammatic view of a reflector assembly, according to the present invention, illustrated in operational relationship with a UV-energy exposure system for curing UV-sensitive ink in a UV-ink printing process.
Figure 2:
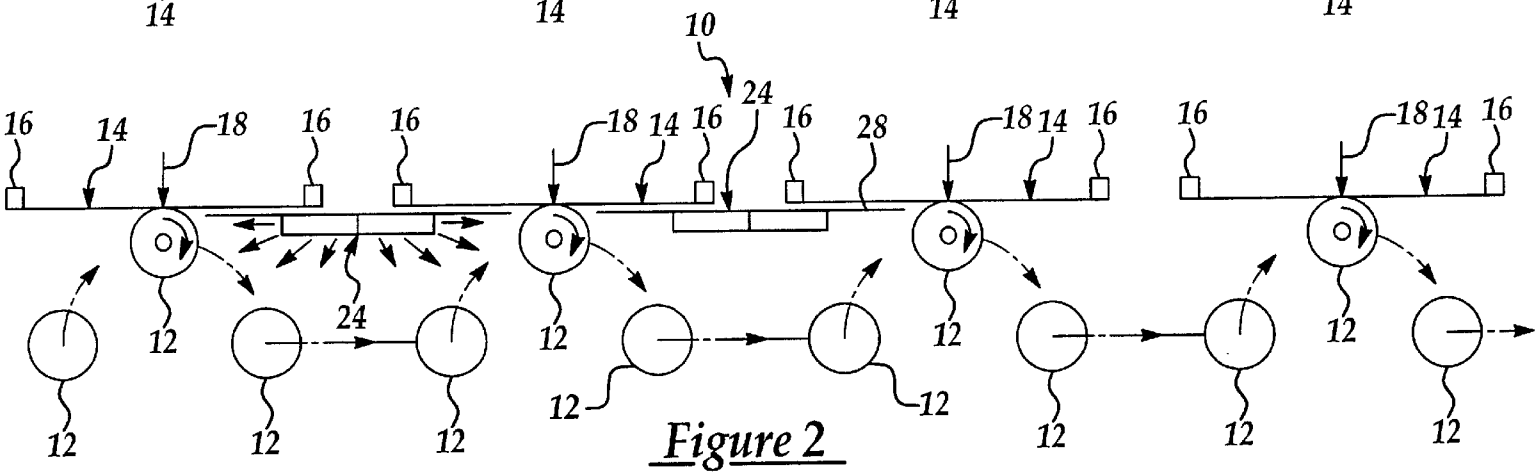
FIG. 2 is a diagrammatic elevational view of the reflector assembly and UV-energy routing system of FIG. 1.
Figure 3:
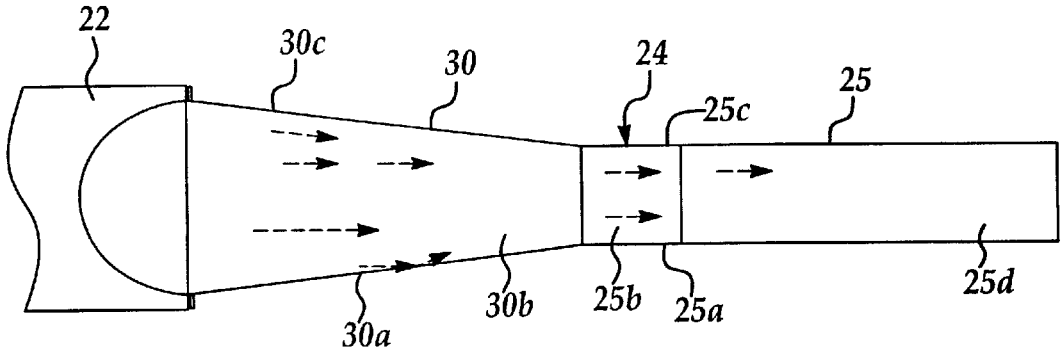
FIG. 3 is an elevational view of the reflector assembly of FIG. 1.
Figure 4:
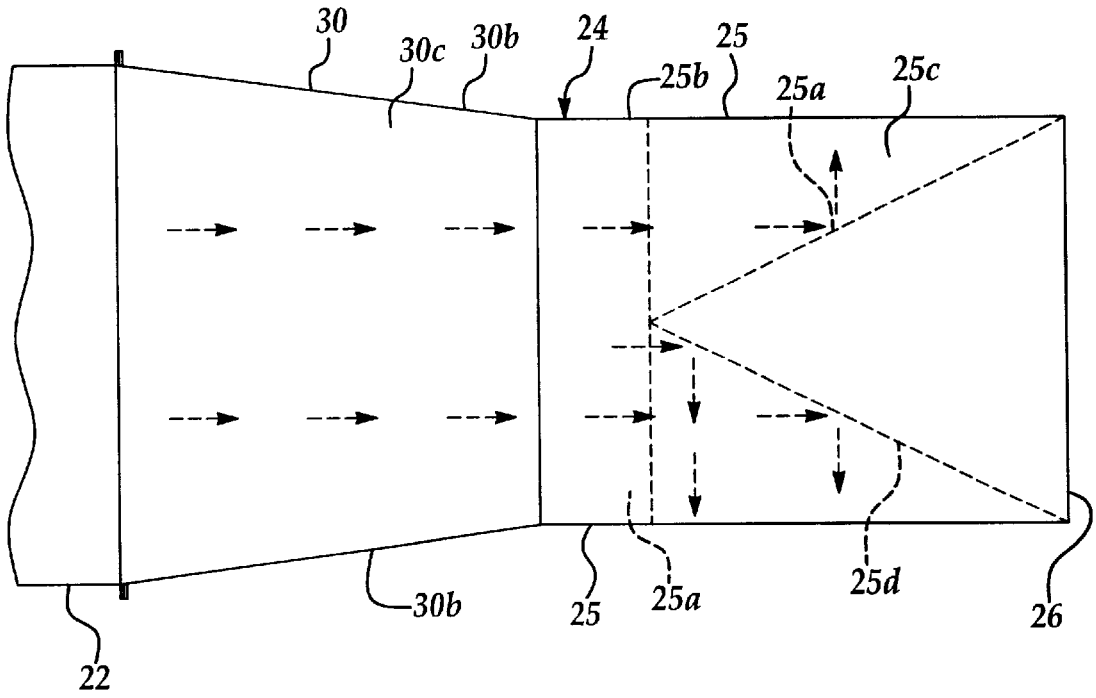
FIG. 4 is a plan view of the reflector assembly of FIG. 1.

Referring now to the figures, throughout which like numerals are used to designate like structure, a UV-energy exposure system, generally indicated at 10, for a UV-ink printing process is shown. The system 10 is particularly suitable for the glassware-decorating industry in which various glass substrates, e.g., glass bottles, are decorated with multiple layers of UV-energy curable compositions. In the description that follows and as shown in FIGS. 1 and 2, the article, or substrate, is a glass bottle 12. It should be appreciated that, however, the system 10 is also suitable for substrates made from other than glass, such as plastic and ceramic, and may include container—slike cups, dishes, glasses, vases, and other decorative wares—sheets, figurines, tiles, and the like. In particular and with respect to glass sheets, those having ordinary skill in the art will appreciate also that they may be used as windshields, sidelights, and backlights in motor vehicles. It should further be appreciated that the substrate 12 can have any suitable size and shape and be printed with any suitable colors and number thereof.

The system 10 includes a plurality of sequential screen-printing stations, generally indicated at 14, which are disposed along a substantially continuous printing line. Although only four screen-printing stations 14 are shown in each of FIGS. 1 and 2, those having ordinary skill in the art will appreciate that any suitable number of screen-printing stations 14 may be provided within the system 10. It should be appreciated that the number of screen-printing stations 14 usually depends upon the number of print requirements.

At each screen-printing station 14, there is provided a printing screen 16, through which a UV-energy curable composition (not shown) is applied to an underlying glass bottle 12 by an applicator, such as a squeegee 18. Each of the glass bottles 12 to be printed is transported through the system 10 into registration with each of the printing screens 16 by a conveyor system (not shown). While at each of the screen-printing stations 14, each of the glass bottles 12 is adapted to rotate. In FIGS. 1 and 2, the glass bottles 12 are being transported substantially to the right and are rotating clockwise. However, those having ordinary skill in the art will appreciate that the glass bottles 12 can be transported substantially to the left and rotate counterclockwise. Each of the printing screens 16 is adapted to apply the UV-energy curable composition to the glass bottles 12 to, thereby, print an image 20 of a color or texture the same as or different than the image 20 to be printed by each of the other printing screens 16. In this way, a particular composite image is provided for each of the glass bottles 12.

Those having ordinary skill in the art will appreciate that it is important to ensure that an image 20 is at least partially dried or cured before another image 20 is printed over the first image 20. Otherwise, interaction between different UV-curable compositions may cause them to run or bleed, and sharpness of the outline or contour of the composite image will be diminished. Furthermore, at least a portion of the UV-curable composition that remains wet on the glass bottle 12 may adhere to the next printing screen 16, thereby causing further interaction of the UV-curable compositions as well as other related problems. At the same time, it is important to prevent curing of the UV-curable compositions within the screen-printing stations 14 that might be exposed to UV during curing of the images 20.

The freshly applied image 20 is then at least partially cured by a UV-emitting source, preferably a UV lamp 22, located between adjacent screen-printing stations 14. More specifically, each of the UV lamps 22 is positioned generally in the space between and underlying adjacent printing screens 16. With this positioning, the system 10 uses less space and is, thereby, more efficient than conventional systems. After each glass bottle 12 is transported away from each printing screen 16, the image 20 is exposed to UV-energy emitted from the UV lamp 22 for a sufficient duration to at least partially cure the image 20.

The system 10 includes a reflector assembly, according to the present invention and generally indicated at 24, to focus the UV-energy upon a desired location of the glass bottle 12 by reflection and transmission of the UV-energy from at least one reflective surface onto the desired location. The reflector assembly 24 includes a reflector 25 having at least one reflective surface. In one embodiment, the reflector 25 has bottom wall 25*a*, side walls 25*b* extending generally perpendicular to the bottom wall 25*a*, and a top wall 25*c* extending generally perpendicular to the side walls 25*b* and generally parallel to the bottom wall 25*a* to form a generally rectangular reflector. The top wall 25*c* extend longitudinally past the bottom wall 25*a*, preferably for over twice the longitudinal length of the bottom wall 25*a*. The reflector 25 also includes a first partition wall 25*d* and second partition wall 25*e* forming a generally inverted "V" shape and orientated generally perpendicular to the top wall 25*c*. The walls 25*a* through 25*e* are connected together by suitable means such as welding. Preferably, all of the internal surfaces of the reflector 25 are reflective. The reflector 25 is made of a rigid material, preferably a metal material such as aluminum. It should be appreciated that the system 10 can use the highly reflective property of any bright metal or other suitable surface as it applies to incident UV energy.

More specifically, the UV energy from the UV lamp 22 is transmitted through and reflected from the interior surfaces of the reflector assembly 24 and adapted to be applied simultaneously to a plurality of glass bottles 12 through a first slot 26 defined by the top wall 25*c* and the first reflector wall 25*d* and a second slot defined by the top wall 25*c* and the second reflector wall 25*e*. The reflector assembly 24 is disposed between two screen-printing stations 14 to direct the UV energy substantially sideways beneath the screen-printing stations 14 and onto the two printing screen stations simultaneously. In this way, the UV energy is applied a plurality of times to each of the glass bottles 12 to ensure that the image 20 newly printed on the glass bottle 12 is substantially completely cured. In addition, the glass bottle 12 can direct the UV energy in various directions. In this regard, the UV energy can be brought to locations other than just opposed each printing screen 16 and without using a light pipe, a fiber-optic bundle, or the like.

With the system 10, then, a glass bottle 12 is generally transported by the conveyor to a screen-printing station 14 and then away from the screen-printing station 14 underneath a combination of a UV lamp 22 and reflector assembly 24 and then back toward another screen-printing station 14. This substantially cyclical motion of the glass bottle 12 repeats itself continually throughout the remainder of the system 10.

Figure 5:
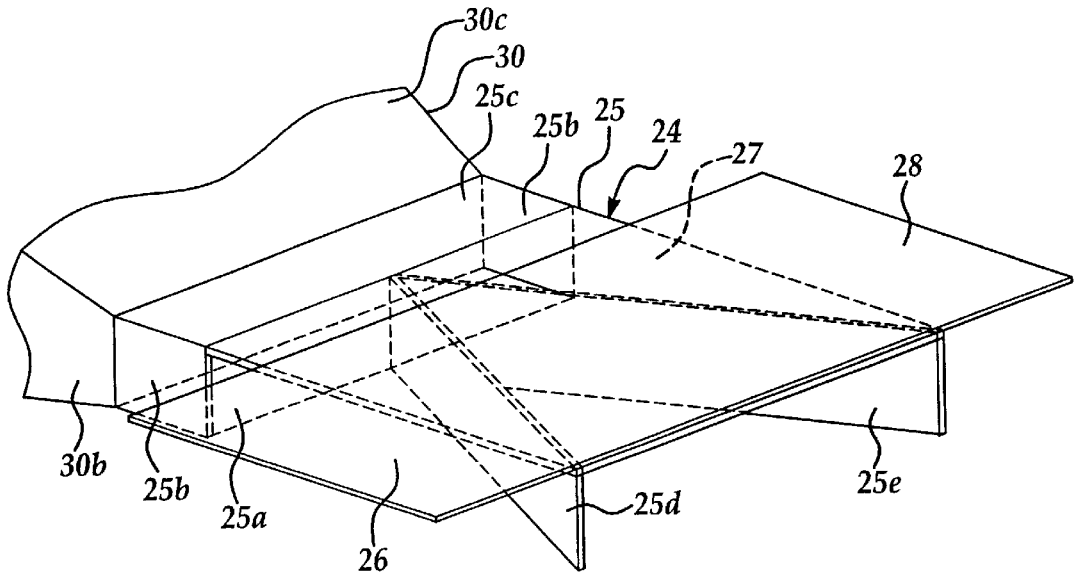
FIG. 5 is a perspective view of the reflector assembly of FIG. 1.

As illustrated in FIG. 5, the reflector assembly 24 includes a shield 28 to protect the corresponding printing screen 16 from exposure to UV energy. The shield 28 is a generally rectangular member attached to the reflector 25. The shield 28 is connected to or integral with the top wall 25*c* and extends laterally a predetermined distance on both sides. Preferably, the shield 28 is made of metal material such as aluminum. It should be appreciated that the shield 28 can be made of any suitable material.

Referring to FIGS. 1 through 5, the reflector assembly 24 includes a funnel 30 interconnecting the UV lamp 22 and the reflector 24. The funnel 30 has bottom wall 30*a*, side walls 30*b* extending generally perpendicular to the bottom wall 30*a*, and a top wall 30*c* extending generally perpendicular to the side walls 30*b* and generally parallel to the bottom wall 30*a* to form a generally funnel shape. The bottom wall 30*a* and top wall 30*c* are generally trapezoidal in shape. The funnel 30 is connected to the UV lamp 22 and reflector 25 by suitable means (not shown). The funnel 30 is made of a rigid material, preferably a metal material such as aluminum. It should be appreciated that the system 10 can use the highly reflective property of any bright metal or other suitable surface as it applies to incident UV energy. It should also be appreciated that all internal surfaces of the funnel 30 are reflective as indicated by the arrows.

Figure 6:
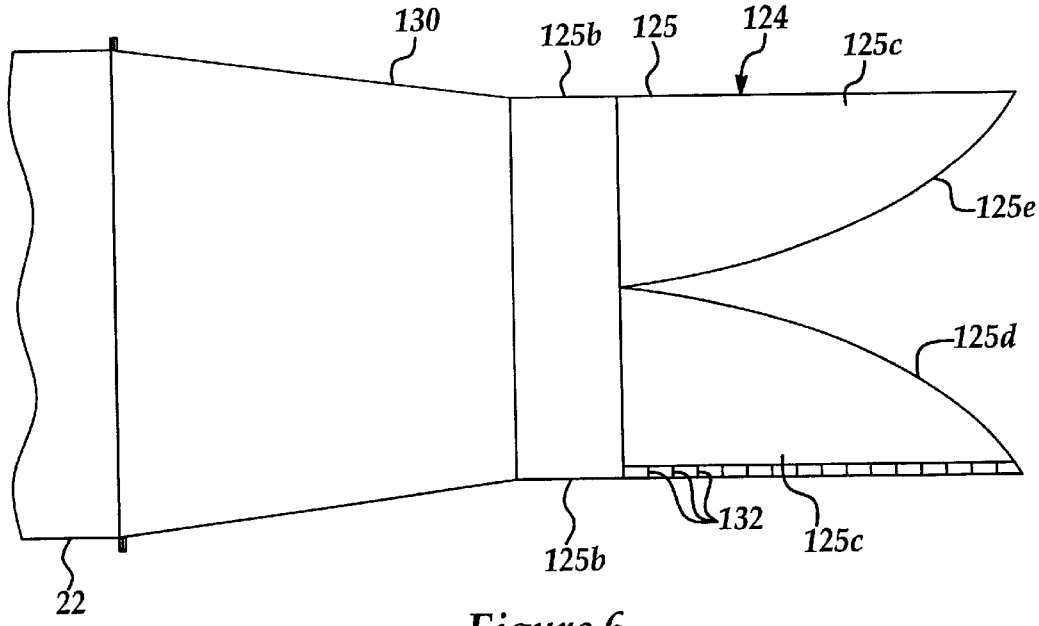
FIG. 6 is an elevational view of another embodiment, according to on, of the reflector assembly of FIG. 1.

Referring to FIG. 6, another embodiment, according to the present invention, of the reflector assembly 24 is shown. Like parts of the reflector assembly 24 have like reference numerals increased by one hundred (100). In this embodiment, the reflector assembly 124 includes the funnel 130 and reflector 125. The reflector 125 can have any suitable shape for the partition walls 125*d* and 125*e* such as arcuate, preferably concave, for example, and a top wall 125*c* that is split to follow the path of the partition walls 125*d* and 125*e*. The reflector 125 may also include a plurality of fins 132 connected to the top wall 125*c* on a lateral side underneath thereof to capture stray UV energy. In this way, a corresponding printing screen 16 is protected from UV and not only by the glass bottles 12. With the shield 128 and the fins 130, the reflector assembly 124 optimally minimizes curing of the UV-energy curable composition contained on the printing screen 16.

The present invention has been described in an illustrative manner. It is to be understood that the terminology that has been used is intended to be in the nature of words of description rather than of limitation.

Many modifications and variations of the present invention are possible in light of the above teachings. Therefore, the present invention may be practiced other than as specifically described.

What is claimed is:

1. A reflector assembly for a UV energy exposure system comprising:

a funnel adapted to be connected to a UV energy source to funnel UV energy from the UV energy source longitudinally; and a reflector connected to said funnel to redirect the UV energy from said funnel laterally to an object.

2. A reflector assembly as set forth in claim 1 wherein said reflector includes a top wall extending longitudinally and at least one partition wall oriented generally perpendicularly to said top wall and at an angle to the UV energy from said funnel.

3. A reflector assembly as set forth in claim 2 wherein said reflector includes a pair of partition walls forming a generally inverted V shape.

4. A reflector assembly as set forth in claim 3 wherein said partition walls are linear in shape.

5. A reflector assembly as set forth in claim 3 wherein said partition walls are arcuate in shape.

6. A reflector assembly as set forth in claim 1 including a shield attached to said reflector to prevent UV energy from passing upwardly from said reflector.

7. A reflector assembly as set forth in claim 1 including a plurality of fins connected to said reflector to capture stray UV energy.

8. A reflector assembly as set forth in claim 1 wherein said funnel has a first longitudinal end and a second longitudinal end, said first longitudinal end being greater in size than said second longitudinal end, said first longitudinal end adapted to be disposed adjacent the UV source.

9. A reflector assembly as set forth in claim 1 wherein said reflector comprises a bottom wall, side walls generally perpendicular to said bottom wall, and a top wall generally perpendicular to said side walls, said top wall extending longitudinally past said bottom wall.

10. A reflector assembly as set forth in claim 1 wherein said reflector is made of a metal material.

11. A reflector assembly as set forth in claim 1 wherein said funnel is made of a metal material.

* * * * *